US008714376B2

(12) United States Patent
Bartel

(10) Patent No.: US 8,714,376 B2
(45) Date of Patent: May 6, 2014

(54) HEAVY-DUTY PIVOT PLATE ADJUSTING JOINT

(75) Inventor: Manfred Bartel, Niesky (DE)

(73) Assignee: Siemens Aktiengesellschaft, Munich (DE)

( * ) Notice: Subject to any disclaimer, the term of this patent is extended or adjusted under 35 U.S.C. 154(b) by 238 days.

(21) Appl. No.: 13/002,111

(22) PCT Filed: Jun. 8, 2009

(86) PCT No.: PCT/EP2009/057022

§ 371 (c)(1),
(2), (4) Date: Dec. 30, 2010

(87) PCT Pub. No.: WO2010/000566

PCT Pub. Date: Jan. 7, 2010

(65) Prior Publication Data

US 2011/0094988 A1 Apr. 28, 2011

(30) Foreign Application Priority Data

Jun. 30, 2008 (DE) ..... 10 2008 030 284

(51) Int. Cl.
*B61G 9/04* (2006.01)
*B61G 9/24* (2006.01)

(52) U.S. Cl.
USPC ..... 213/40 R; 213/46 A; 213/40 S

(58) Field of Classification Search
USPC ..... 213/7, 10, 12, 20, 22, 40 D, 40 R, 40 S, 213/44, 45, 46 A, 46 R, 50, 62 A, 62 R
See application file for complete search history.

(56) References Cited

FOREIGN PATENT DOCUMENTS

| | | | |
|---|---|---|---|
| DE | 10246428 | A1 | 4/2004 |
| DE | 102005033849 | A1 | 1/2007 |
| DE | 102005034527 | A1 | 1/2007 |
| DE | 102007003331 | A1 | 7/2008 |
| DE | 102008008214 | A1 | 9/2008 |
| EP | 1086870 | A2 | 3/2001 |
| EP | 1342637 | A1 | 9/2003 |
| EP | 1407953 | A1 | 4/2004 |
| EP | 1407954 | A1 | 4/2004 |
| EP | 1413493 | A1 | 4/2004 |
| EP | 1747960 | A2 | 1/2007 |
| EP | 1946988 | A1 | 7/2008 |
| RU | 64167 | U1 | 6/2007 |

*Primary Examiner* — Zachary Kuhfuss
(74) *Attorney, Agent, or Firm* — Laurence A. Greenberg; Werner H. Stemer; Ralph E. Locher

(57) ABSTRACT

A heavy-duty pivot plate adjusting joint for railroad freight cars connects multi-part car sections. To this end, the adjusting joint is configured such that each drawbar end is provided with only one end coupling rod part having a spring column, and the drawbar is connected by way of the drawbar end plates to the support bearing plates of an under frame provided on a car side. Each adjusting joint is provided with an adjusting point pivot plate, wherein a pivot plate roll surface is present directly at the pivot plate or at the adjoining contact surfaces transmitting pressure force, the surfaces having a spherical or two-dimensional shape. A configuration of the adjusting joints in a "regular embodiment" is proposed, wherein the distance of the transmission end points of balance is smaller than the distance of the spring travel limiters.

4 Claims, 3 Drawing Sheets

Figure 5:
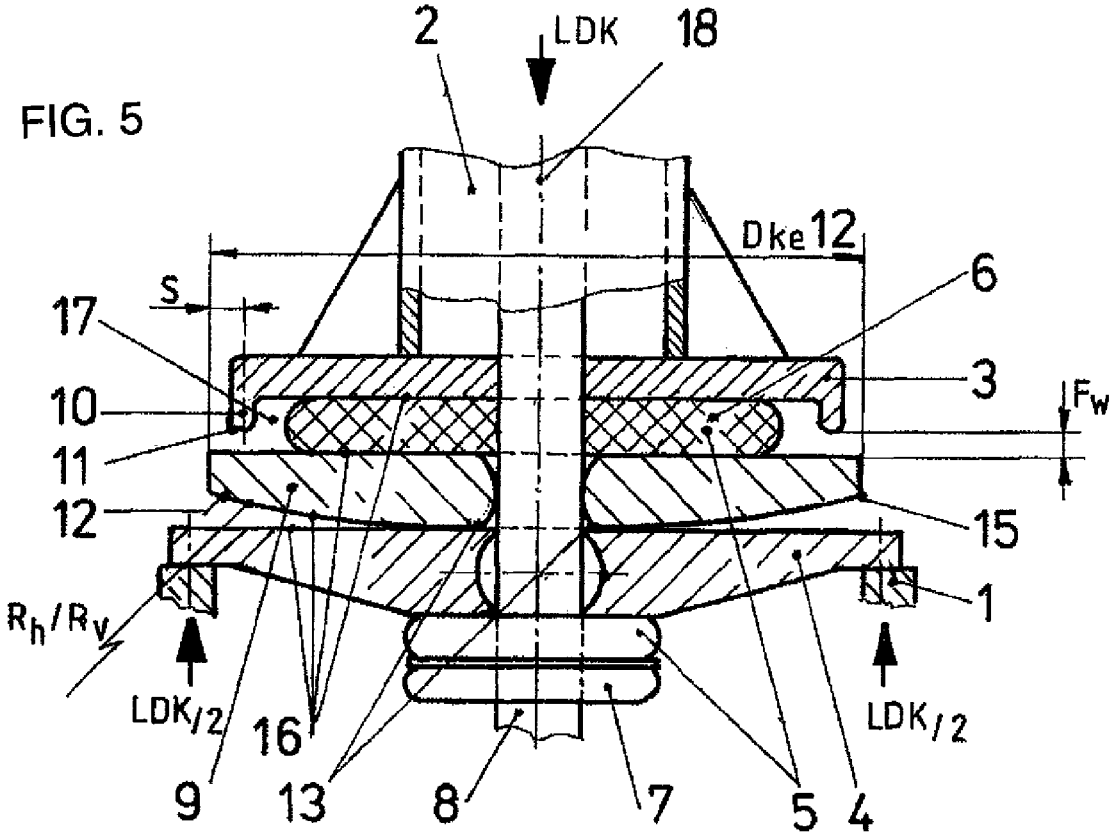

FIG. 5.1
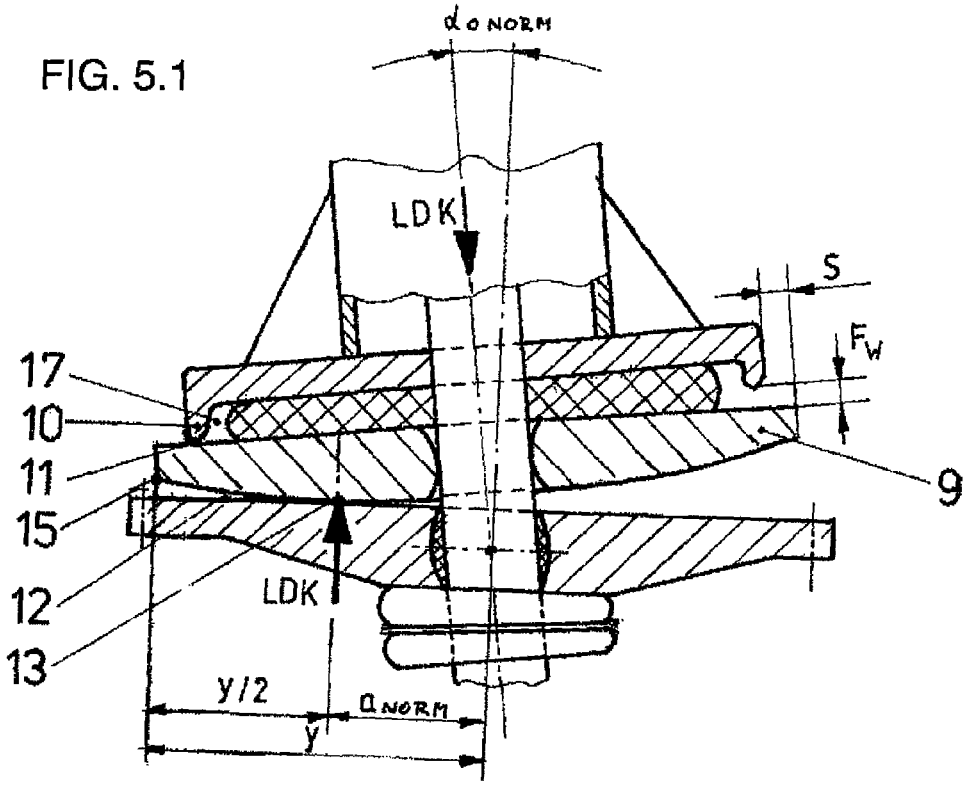
FIG. 5.2
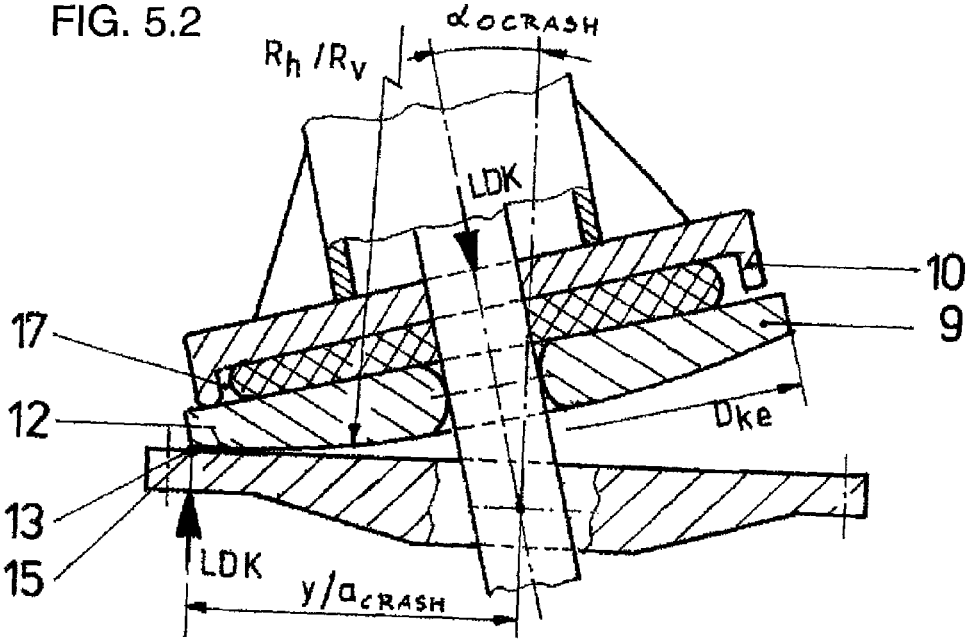

HEAVY-DUTY PIVOT PLATE ADJUSTING JOINT

The invention relates to a heavy-duty pivot plate adjusting joint having a single spring column arrangement for heavily loaded drawbars for connecting rail cars to multi-part car sections according to the preamble of claim 1. Heavy-duty adjusting joints with a single spring column arrangement at the ends of drawbars for coupling car units have already been disclosed.

PRIOR ART

DE 10246428.6 has already proposed a solution with a single spring column arrangement.

In this design, the pressure-side spring-plate-damping elements are mounted in support cages. A defined free distance "a" for suspension travel and pivoting travel is provided between the upper cage edge and the support bearing plate, said free distance "a" being completely used up at a defined swing out angle of the drawbar and when there are initial longitudinal pressure forces. After the cage edge and the support bearing plate touch, there is a rigid connection between the drawbar and car. The transmitting of the undamped longitudinal force has a negative effect when impacts occur and can lead to deformation and unsteady running of the car and the generation of noise.

Furthermore, DE 10 2005 034 527 has proposed a solution with a double spring column arrangement. This design ensures large restoring torques and an improved elastic connection with longitudinal pressure forces. However, in addition to its significant advantages it requires a disadvantageously large installation space which is not available in many cases and also entails a relatively high intrinsic mass and relative high costs.

DEFINITION OF THE OBJECT

The object of the invention is to provide a heavy-duty adjusting joint for heavily loaded drawbars which avoids the disadvantages of the known solutions and ensures, by virtue of an optimum action principle, better adjusting joint parameters with a relatively small installation space and a largely damped connection to the car when large longitudinal pressure forces occur. The intention is to reduce the intrinsic mass of the car sections and the manufacturing costs.

The object is achieved according to the invention by means of the features of claim 1. Advantageous additions to the invention can be found in the subclaims. The essential feature of the invention is that at each drawbar end just one end coupling rod is arranged in a space-saving fashion with a pressure-side spring column which its through-pressure force central by a movable pivoting washer which is arranged in front of or behind of the pressure-side spring washers depending on the requirements and enables, under the control of spring travel limiters by its pressure-side spring travel and a spring washer rolling surface, a long-lasting elastic junction with the underframe which is force-dependent and angle-dependent as a function of the deflection angle of the drawbar.

In this process it is possible to generate large balanced restoring torques between the drawbar and the car body as a function of the deflection angle of the drawbar and the initial longitudinal pressure force.

Further features of the invention are that, depending on the operating conditions and the definition of the object, two specific designs are provided as a normal case, for example, for the solution of the problem of providing protection against derailing when longitudinal pressure forces occur in goods cars in shunting mode or in passenger train cars in order to improve the anti-crash behavior in the event of accidents.

With the proposed "normal design", the distance between the transmitting end tilting points is therefore made smaller than the distance between the spring travel limiters.

In the anti-crash design, in order to avoid horizontal and vertical veering out of the car bodies in the event of a crash the distance between the end tilting points is selected to be as large as possible in order to allow the largest possible restoring torque to act, wherein the distance between the transition end tilting points is larger than or equal to the distance between the spring travel limiters.

The above solution according to the invention makes a contribution to optimizing the adjusting joint principle with the result of a relative increase in power despite the minimal spatial requirement and with respect to a low intrinsic mass and lower costs of manufacture and maintenance. The safety level during operation with passenger train cars and light-weight goods car units is increased.

EXEMPLARY EMBODIMENT

Exemplary embodiments in the invention will be explained in more detail below with reference to drawings.

Figure 2:
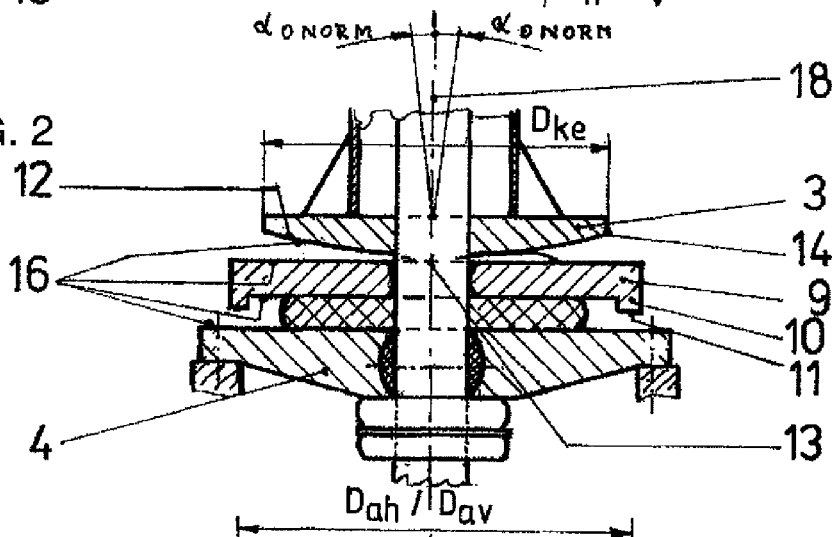
Figure 3:
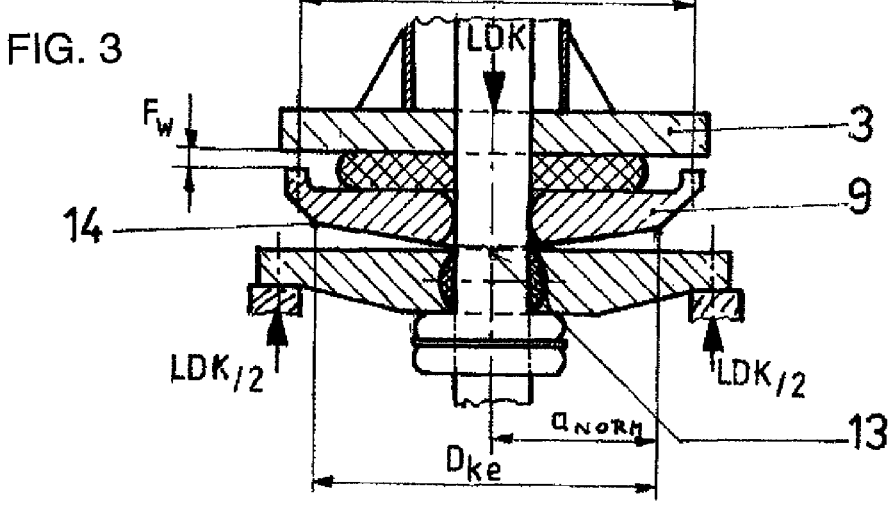
Figure 4:
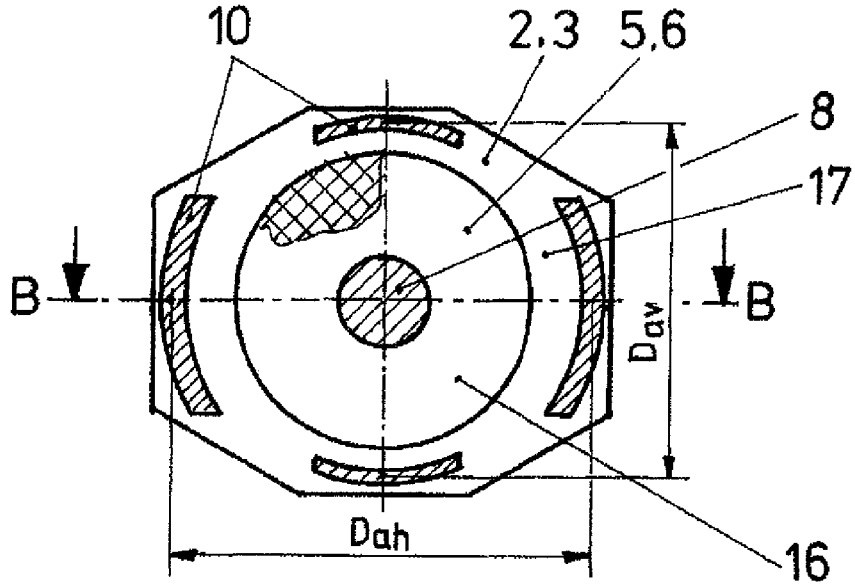

In the drawings:

FIGS. 1, 2, 3 and 5: show a section B-B in FIG. 4

Figure 1:
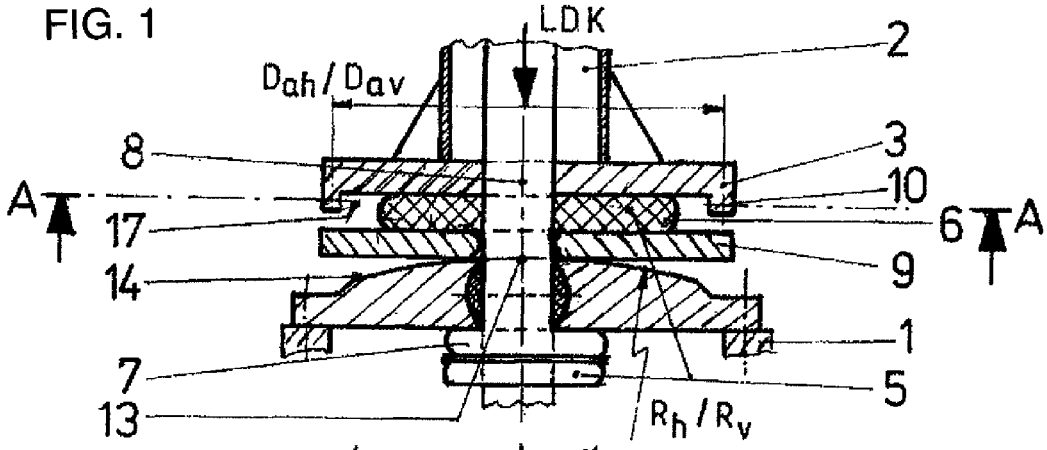

FIG. 4: shows a section A-A in FIG. 1, and

FIGS. 5.1 and 5.2: show a section B-B in FIG. 4 with a swung-out drawbar.

FIGS. 1, 2 and 3 each show a horizontal cross section through three variants of heavy-duty pivot plate adjusting joints of a "normal design" with the arrangement according to the invention. In this context, in each case pressure-side spring washers 6 and a movably mounted adjusting joint pivot plate 9 are located at each end between the support bearing plate 4, which is attached to the car underframe 1, and the drawbar end plate 3 of the drawbar 2. The arrangement of the spring travel limiters 10 can be found in FIG. 4.

In order to support the pressure-side spring washer 6 of the spring column 5, a support-cage-like space 17 is formed by the spring travel limiters 10 in conjunction with the drawbar end plate 3 or the adjusting joint plate 9, or else the support bearing plate 4.

Pressure-side spring travel Fw is respectively available for the symmetrical and asymmetrical movement of the spring travel limiters 10, which secure and bound the optimum, horizontal and vertical deflection of the adjusting joint plates.

When the drawbar swings out, first an asymmetrical contact occurs with the corresponding plate on the swing-out side.

When the longitudinal pressure force LDK increases, the pivot plate 9 is then pressed back again into the support-cage-like space. The application of load to the adjusting joint pivot plate 9 occurs in each case via the longitudinal-pressure-transmitting point 13, which ends on all sides on the "transmitting end tilting point" 14 in the "normal design" solution. Here, the distance between the "transmitting end tilting points" 14=width dimension DKe is always smaller than the distance between the spring travel limiters 10. This ensures that even when there are large longitudinal pressure forces LDK the force profile over the restoring and tilting movement of the adjusting joint pivot plates 9 still very largely occurs elastically via the pressure-side spring washer. The maximum restoring torque which can be reached for the car body in the "normal design" is achieved here by the lever arm with the half dimension $y=a_{NORM}$ in the horizontal plane and in an analogous fashion in the vertical plane.

FIGS. 5, 5.1 and 5.2 show the solution of a pivot plate adjusting joint in a combined anti-crash design with a horizontal and vertical effect, in particular also for passenger train cars.

The combined anti-crash design corresponds to the normal design for goods cars with the exception of the arrangement of the spring travel limiters 10 and the embodiment of the adjusting joint pivot plate. In order to increase the anti-crash stabilization performance, a larger value is selected for the horizontal and vertical distance dimensions of the spring travel limiters 10. In this case, the distance between the transmitting end tilting points 15 becomes equal to or greater than the distance between the spring travel limiters 10. This permits the following structural principle according to FIGS. 5, 5.1 and 5.2 in conjunction with the use of pivot plates with the horizontal and/or vertical rolling face 12 or even over corresponding non-continuous face curvatures:

During normal operation with normal drawbar deflections ($\alpha_{NORM}$) corresponding approximately to a track radius of 250-300 m, the longitudinal-force-transmitting point 13 with its lever arm $\alpha_{NORM}$ is located, according to FIG. 5.1, approximately in the center between the longitudinal axis 18 of the drawbar 2 and the transmitting end tilting point 15 corresponding to the distance "y". In the case of normal and relatively large longitudinal pressure forces LDK, the transmission of pressure remains elastic, and the pivot plate does not yet adjoin the right-hand spring travel limiter 10.

If a relatively large crash force acts, also paired with a relatively large deflection angle $\alpha_{OCRASH}$, the application of force occurs directly at the point 15 and therefore at the largest possible lever arm $a_{CRASH}$ according to FIG. 5.2. The largest possible anti-crash restoring torque therefore acts. The extreme longitudinal pressure force is then applied rigidly via the spring travel limiters 10 with their pressure contact faces 11 and the adjoining adjusting joint pivot plate 9 in a directly and immediately effective fashion to the support bearing plate 4 and therefore to the underframe 1, as a result of which a rapid and optimum anti-crash effect occurs.

LIST OF REFERENCE SYMBOLS

1 Underframe
2 Drawbar
3 Drawbar end plate
4 Support bearing plate
5 Spring column
6 Pressure-side spring washer
7 Tension-side spring washer
8 End coupling rod part
9 Adjusting joint pivot plate
10 Spring travel limiter
11 Pressure contact faces
12 Pivot plate rolling face
13 Longitudinal-force-transmitting point
14 Transmitting end tilting point normal design
15 Transmitting end tilting point anti-crash design
16 Pressure-force-transmitting contact face
17 Support-cage-like space
18 Longitudinal axis of the drawbar
LDK Longitudinal pressure force
$R_H$ Horizontal adjusting joint radius
$R_V$ Vertical adjusting joint radius
$F_w$ Pressure-side spring travel
$D_{ah}$ Width dimension across the spring travel limiters 10
$D_{av}$ Height dimension across the spring travel limiters 10
$D_{ke}$ Width dimension across the transmitting end tilting
y Distance—center of adjusting joint to transmitting end tilting point 15
S Protruding distance
$\alpha_{oNORM}$ Drawbar deflection angle in normal position
$\alpha_{oCRASH}$ Drawbar deflection angle in crash position
$a_{NORM}$ Maximum lever arm of the restoring joint in "normal design"
$a_{CRASH}$ Maximum lever arm of the restoring joint in "crash design"

The invention claimed is:

1. A heavy-duty pivot plate adjusting joint for a heavily loaded drawbar for connecting railroad cars to multi-part car sections and for generating horizontal and/or vertical restoring torques in car bodies during a development of longitudinal pressure forces in a block train to avoid derailing and consequences thereof, the heavy-duty pivot plate adjusting joint comprising:

a drawbar end plate;

an end coupling rod part disposed at an end of the drawbar;

a pressure-side spring washer disposed at least on a pressure side;

a car-side support bearing plate for connecting to an under frame of a railroad car;

only one pressure-side spring column, at a drawbar end of the drawbar just one said end coupling rod part is disposed with said only one pressure-side spring column in such a way as to connect the drawbar to said car-side support bearing plate via said drawbar end plate;

an adjusting joint pivot plate disposed between said drawbar end plate and said car-side support bearing plate;

said drawbar end plate, said adjusting joint pivot plate and said car-side support bearing plate having contact faces, at least one of said contact faces defining a pivot plate rolling face for transmitting a pressure force, between one of said adjusting joint pivot plate and the drawbar or said car side support bearing plate; and spring travel limiters having pressure contact faces disposed either on said drawbar end plate, on said adjusting joint pivot plate, or on said car-side support bearing plate, and define a support-cage-shaped space for receiving said pressure-side spring washer, and are at a defined distance from an assigned one of said pressure contact faces, transmitting the pressure force, in a direction of a pressure-side spring travel.

2. The heavy-duty pivot plate adjusting joint according to claim 1, wherein said pivot plate rolling face has, for a purpose of moving a longitudinal-pressure-transmitting point in a case of pivoting movements, a surface which is spherical or shaped in two dimensions for a vertical and/or horizontal adjusting joint restoring effect.

3. The heavy-duty pivot plate adjusting joint according to claim 1, wherein a distance between transmitting end tilting points is shorter than a distance between said spring travel limiters with said pressure contact faces.

4. The heavy-duty pivot plate adjusting joint according to claim 1, wherein for increasing an effective restoring torque of the heavy-duty pivot plate adjusting joint, a distance between transmitting end tilting points is equal to or slightly larger than a distance of said spring travel limiters with said pressure contact faces.

* * * * *